US006594918B2

(12) United States Patent
Hatfield et al.

(10) Patent No.: US 6,594,918 B2
(45) Date of Patent: Jul. 22, 2003

(54) ARTICLE OF FOOTWEAR INCLUDING A TENTED UPPER

(75) Inventors: Tinker L. Hatfield, Portland, OR (US); Michael A. Aveni, Lake Oswego, OR (US); Michael R. Friton, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/051,171

(22) Filed: Jan. 22, 2002

(65) Prior Publication Data

US 2002/0066211 A1 Jun. 6, 2002

Related U.S. Application Data

(63) Continuation of application No. 09/626,139, filed on Jul. 26, 2000, now Pat. No. 6,367,168.

(51) Int. Cl.[7] ..... A43B 13/38; A43B 13/22; A43B 3/24; A43B 7/06; A43B 23/00

(52) U.S. Cl. ..... 36/45; 36/72 R; 36/96; 36/101; 36/38; 36/7.1 R

(58) Field of Search ..... 36/11.5, 45, 49, 36/51, 55, 56, 57, 58.6, 72 R, 73, 1, 96, 101, 3 A, 7.1 R, 7.3; 602/23, 27, 29, 30; 128/882

(56) References Cited

U.S. PATENT DOCUMENTS

| | | | | |
|---|---|---|---|---|
| 4,677,767 A | * | 7/1987 | Darby | 36/11.5 |
| 4,972,610 A | * | 11/1990 | Tong | 36/11.5 |
| 5,467,537 A | * | 11/1995 | Aveni et al. | 36/11.5 |
| 6,237,250 B1 | * | 5/2001 | Aguerre | 36/11.5 |

* cited by examiner

*Primary Examiner*—Anthony Stashick
(74) *Attorney, Agent, or Firm*—Banner & Witcoff, Ltd.

(57) ABSTRACT

An article of footwear has an upper in a tented arrangement. The article of footwear includes a sole and an upper including a shroud. The article of footwear further includes a foot engaging system for joining a foot of a user to the sole, and a biasing system which includes a plurality of frame members that urges or influences the shroud away from the foot of the user. The article of footwear further includes a plurality of straps for holding the foot to the sole in which one of the straps engages the heel. The straps are located on an exterior surface of the shroud or alternatively they are located in the interior of the shroud. Air gaps are created between the shroud and the foot for ventilation. Several foot booties for holding a foot have vent openings for providing air to ventilate the foot of a wearer. Further, the foot booties are combined with straps, in which the straps are disposed between the shroud and the foot booties. The upper has a flexible sheet of material that is interconnected with a plurality of frame members that urges the sheet away from the foot of a wearer.

37 Claims, 4 Drawing Sheets

ARTICLE OF FOOTWEAR INCLUDING A TENTED UPPER

CROSS-REFERENCE TO RELATED APPLICATION

The present continuation application claims priority to U.S. application Ser. No. 09/626,139, filed Jul. 26, 2000 now U.S. Pat. No. 6,367,168.

FIELD OF THE INVENTION

This invention relates to an article of footwear, especially for athletic shoes. More particularly, the invention relates to a comfortable, lightweight athletic shoe with an upper having a covering and a supporting framework for creating a tent-like structure.

BACKGROUND OF THE INVENTION

Proper fitting and comfortable shoes are important for foot development and athletic performance. One function of a shoe is to support and protect the foot. To this end, a shoe, typically an athletic shoe, includes a sole to provide traction, support and cushioning. A shoe also includes an upper that is typically stitched and/or glued to the upper periphery of the sole. The upper is intended to contact and hold the foot of the wearer to the sole, to provide a tight and comfortable fit. The upper typically also has a fastening system, such as a lace and eyelets in the upper material. The ends of the lace are tied together so the upper squeezes the foot within the shoe.

Uppers are frequently constructed of leather and other materials having properties similar to leather. Leather and other similar materials may retain moisture and do not permit the foot to readily breathe. The foot may generate an excessive amount of moisture, may become hot or overheated in an upper made of leather or similar materials. When an athletic shoe is used in hot weather, the temperature and moisture within the interior space of the upper may become elevated. This problem will effect the overall comfort and the fit of the shoe for the wearer. Further, these materials are relatively heavy making them unsuitable for certain athletic shoes, such as running shoes.

The disadvantages of leather and leather-like materials for shoe upper construction led to the development of uppers constructed at least in part of various synthetic materials. Most of these synthetic materials are polymer meshes that are light and breathable. Meshes can be advantageous in athletic shoes where a lightweight shoe is important to the athlete's performance during athletic activities, e.g., running and walking events. The mesh also allows the foot to breathe thereby keeping the foot relatively dry during athletic activities. However, the breathability of mesh materials can be improved if they are not contacting the surface of the foot or if a small portion of the material is contacting a foot.

One approach to providing air circulation to the foot is disclosed in U.S. Pat. No. 757,424 to Vohl. This patent discloses a lining that is placed inside of a shoe forming gaps between the lining and the upper material. The lining includes ribs fastened to the outer surface of the lining. This structure provides for air to flow within the gaps with the intent to ventilate the shoe. While Vohl has ribs fastened to the lining material, the system is used within an upper of a shoe. The lining reduces the interior space within the upper thereby undesirably reducing the shoe size and potentially causing the wearer discomfort at the skin because the foot will be rubbing or sensing the ribs within the upper. While alleging to provide increased air circulation to the foot, this lining does not appear to be suitable for a lightweight athletic shoe.

Sandals and similar footwear provide for support of the foot. These types of footwear leave the foot or at least the forefoot portion of the foot exposed. While these types of footwear provide for air circulation around the foot, because the foot is exposed, they may not provide suitable protection for the foot. The foot may be injured by debris or sunlight ultraviolet rays may damage the exposed foot. Additionally, sandals and similar type of footwear are not typically designed for athletic activities, such as running or cross-training.

Accordingly, an improved shoe upper for an article of footwear was needed to overcome the problems in the prior art.

SUMMARY OF THE INVENTION

The present invention is directed to an article of footwear having an upper in a tented arrangement to solve the problems in the prior art.

One aspect of the present invention is an article of footwear, such as an athletic shoe. The article of footwear includes a sole for engaging a ground surface and an upper including a shroud. The article of footwear further includes a foot engaging system for holding a foot of a user to the sole, and at least one frame member that urges or influences the shroud away from the foot of the user. The article of footwear further includes a plurality of straps for holding the foot to the sole in which one of the straps engages the heel. In another aspect of the present invention, straps are located on an exterior surface of the shroud in which multiple air gaps are created for cooling the foot. In another aspect of the present invention the straps are located interior of the shroud for creating a substantial air gap for air to be conveyed to the foot.

In another aspect of the present invention, the article of footwear further includes a foot bootie system for holding the foot of a wearer. The foot bootie system includes vent openings for providing air to ventilate the foot of a wearer. Further the foot bootie system is combined with a plurality of straps for securing the foot to the sole of the shoe.

In another aspect of the present invention an article of footwear includes a tented shroud including a shroud and a frame member attached to the sole. The tented shroud covers the entire foot or a forefoot portion. In another aspect of the present invention, an upper has a flexible sheet of material that is interconnected with a plurality of frame members for tenting the flexible sheet of material.

It is an object of the present invention to provide a shoe that achieves support for a user's foot with a maximum amount of flexibility and breatheability with minimum weight. It is a further object of the invention to minimize the amount of the upper contacting the foot of a wearer. Yet another object of the invention is to provide a structure to ventilate the foot of a wearer.

The above and other objects, features and advantages of the present invention will be readily apparent and fully understood from the following detailed description of preferred embodiments, taken in connection with the appended drawings.

DETAILED DESCRIPTION OF THE PREFERRED EMBODIMENTS

Figure 1:
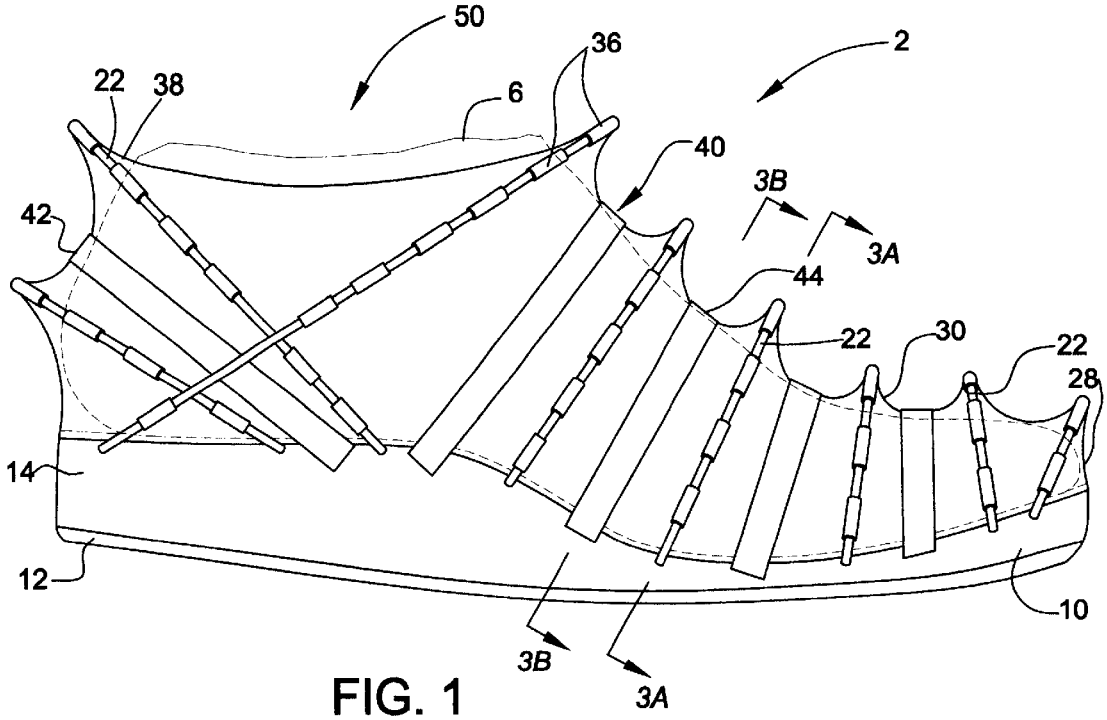
FIG. 1 is a side elevational view of the lateral side of an article of footwear of the present invention.

With reference to FIGS. 1–8, an article of footwear, for example an athletic shoe, in accordance with the present invention is illustrated. The article of footwear is generally referred to herein as a shoe and designated as numeral 2. The shoe 2 includes a sole 10 and an upper 30. The upper 30 has a foot engaging system 40 and a tented or tent-like structure to protect the foot and provide enhanced breathability. It should be noted that the terms "tented" or "tent-like" are defined herein as a structure having a layer of material or outer covering that is stretched or otherwise connected to a supporting framework of elements so as to form a substantially enclosing structure. Further the term "tenting" is defined herein as creating a tented or tent-like structure.

The shoe 2 has a medial side 16 and a lateral side 18. When the shoe 2 is worn the lateral side 18 generally faces away from the center line of a user's body. Likewise, the medial side 16 generally faces inward towards the centerline of a user's body. The sole 10 may further include an outsole 12 and a midsole 14. The outsole 12 provides a lower ground engaging surface designed for traction and typically made of a tough rubber material for wear resistance. The midsole 14 provides cushioning and support and is more compressible than outsole 12 to achieve its cushioning function. Any conventional sole design may be used provided that it has sufficient support and traction for the foot of the wearer for the desired activity or sport to be performed.

Figure 3A:
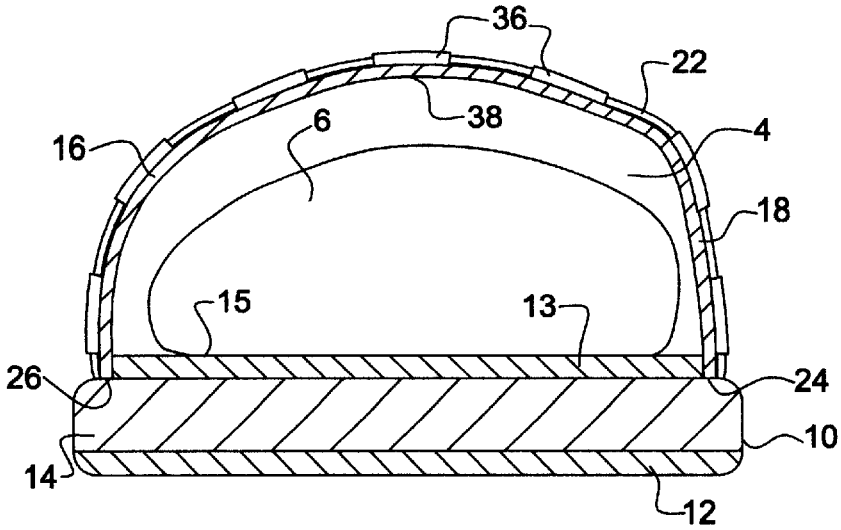
FIG. 3A is a cross-section taken through line 3A—3A of FIG. 1.
Figure 3B:
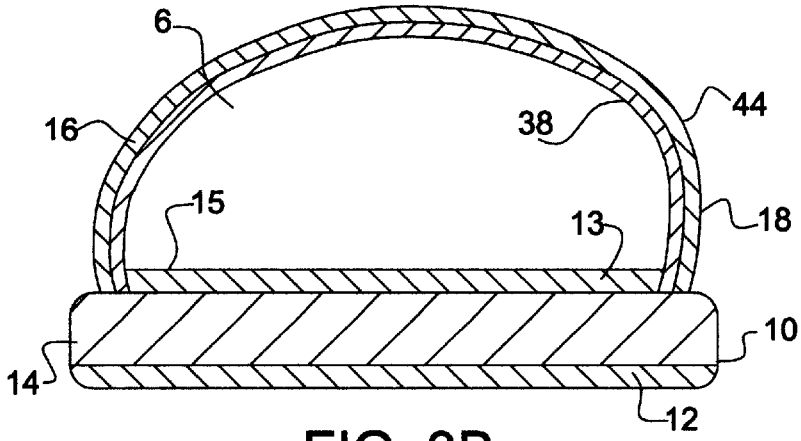
FIG. 3B is a cross-section taken through line 3B—3B of FIG. 1.

As shown in FIGS. 3A and 3B, the shoe 2 may include an insole or sockliner 13 disposed inside of the shoe 2 and is preferably positioned between the foot 6 of the wearer and the sole 10. In addition, the sockliner 13 further includes an upper surface defining a footbed 15, that is the portion of the shoe 2 that is in contact with the bottom of the foot 6 of the wearer. The sockliner 13 provides additional cushioning and shock absorption of the shoe 2. If desired, the sockliner 13 may be removable and replaceable for the shoe 2.

Figure 4:
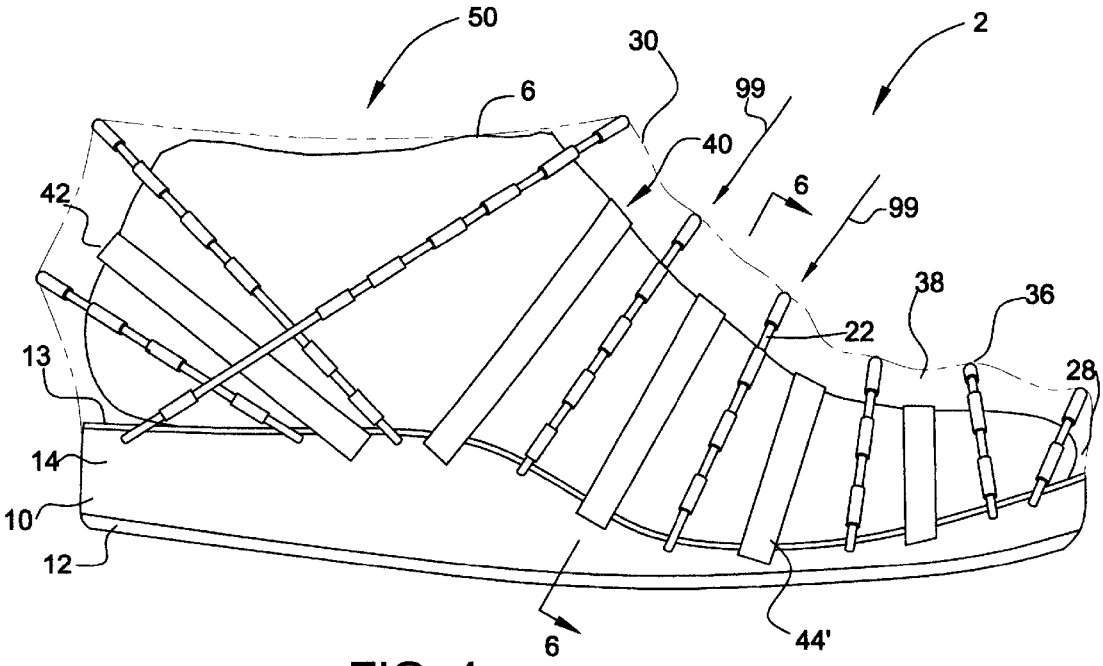
FIG. 4 is a schematic side elevational view of an alternate embodiment of an article of footwear of the present invention.
Figure 7:
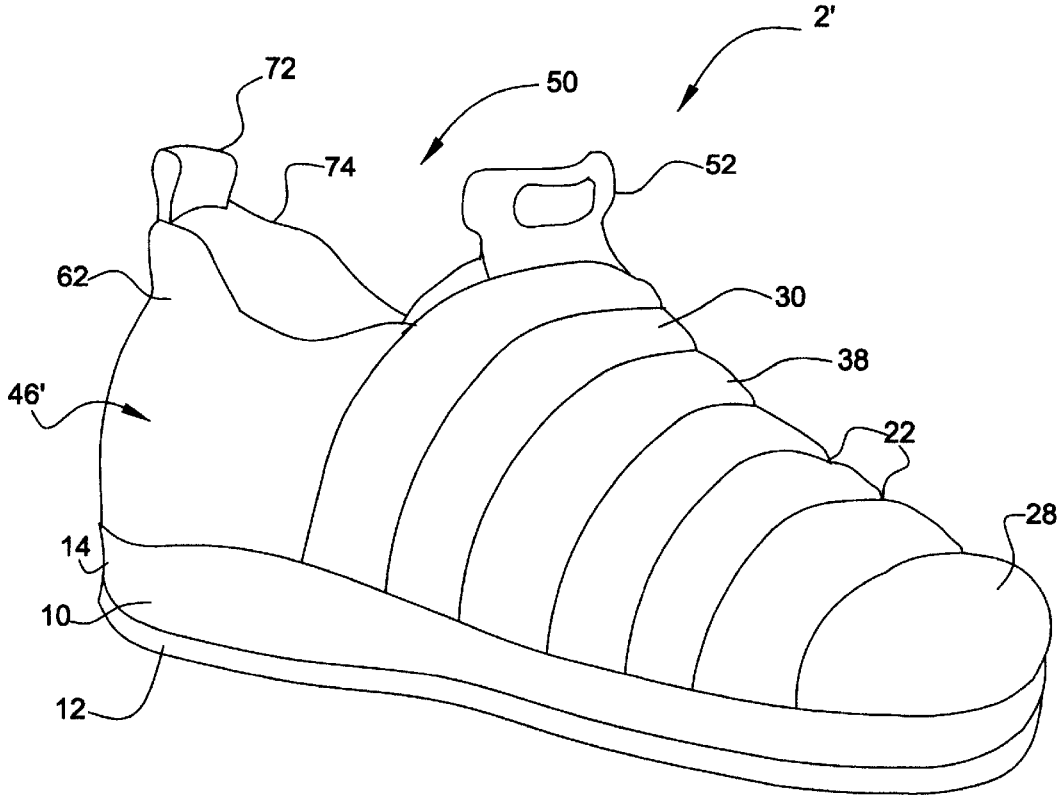
FIG. 7 is an isometric view of an article footwear according to another alternative embodiment of the present invention where the shroud substantially encloses the forefoot portion of the shoe.

The shoe 2 further includes the foot engaging system 40. The foot engaging system 40 serves to hold or secure the foot 6 of a wearer to the shoe 2, in particular, to the footbed 15 and the sole 10. A foot opening 50 enables a user to insert his or her foot 6 through the shroud 38 and into the shoe 2. The foot engaging system 40 may be disposed on the top of the shroud 38 as shown in FIG. 1 or may be disposed below the shroud 38 as shown in FIGS. 4 and 7.

The upper 30 includes an outer covering or a shroud 38 and supporting framework of a plurality of biasing or frame members 22 forming the tented or tent-like arrangement of the shoe 2. The shroud 38 functions to conceal and to provide breathability for the foot 6 of a wearer within the shoe 2. Additionally, the shroud 38 protects, and screens the foot 6 within the shoe 2 from debris. The frame members 22 are connected to the shroud 38 so as to influence or otherwise keep at least a portion of the shroud 38 away from the foot 6 of the wearer. The upper 30 similarly includes a medial side 32 and a lateral side 34. The shroud 38 may be secured to the sole 10 in any conventional manner, e.g., by stitching and/or gluing to the top surface of sole 10. Although the shroud 38 is preferably attached to the sole 10 on the medial side 16 and the lateral side 18, the shroud 38 may be removably attached from the sole 10 and to the frame members 22. Toe box 28 may include a wear resistant material, such as a plastic or rubber, located on the exterior or interior of the front portion of the shroud 38 for extending the life of the shoe 2.

With reference to the embodiments shown in FIGS. 1–6, the shroud 38 extends from the lateral side 18 to the medial side 16 of the sole 10 and extends from the toe box 28 to the heel of the user including the entire foot 6 of the wearer, including the rearfoot region. Shroud 38 may be attached directly to sole 10 comprising most of the external surface of upper 30. With reference to the embodiment shown in FIGS. 7 and 8, the shroud 38, however can cover just the forefoot region and toe box 28 for the foot 6.

Referring to the embodiments shown in FIGS. 1–8, the upper 30 further includes a plurality of frame members 22 extending from the medial side 16 to the lateral side 18 of the shoe 2. The frame members 22 contact the shroud 38 to form the tent-like structure of the shoe 2. The frame members 22 are preferably constructed and arranged with a resilient bias such that the shroud 38 is urged or influenced away from the foot 6 of a user. The urging feature of the frame members 22 pushes the shroud 38 outward. This substantially keeps the shroud 38 from contacting the foot 6 in at least the regions adjacent to frame members 22 and keeps the foot 6 or a portion of the foot 6 enclosed in the tent-like arrangement of the shoe 2. If desired, some frame members, not shown, may run in the longitudinal direction along the medial side 32 or lateral side 34 of the upper 30. That is the longitudinal direction running from the toe box 28 to the rear heel portion of the shoe 2. These additional frame members could join adjacent frame members 22 running between the lateral 18 and medial 16 sides.

The frame members 22 are preferably attached to the sole 10, in particular to the midsole 14 of the shoe 2. The method of attaching of the frame member 22 to the sole 10 may be of any desirable method, such as bonding with adhesive, molded in situ, or a mechanical fastening technique. In one arrangement, the midsole 14 includes a plurality of depressions formed to mate with the lateral ends 24 and medial ends 26 of the frame members 22. In yet another arrangement, the frame members 22 may be removable such that different rods of various elasticity properties, weights or sizes may be selectively changed by the wearer. This is advantageous for wearer options depending on the sport of intended use.

The frame members 22 are preferably elongated rods of any desired cross section, such as circular, square, rectangular, or triangular. The frame members 22 are preferably non-conductive, and resilient in that they easily and quickly recover to a desired shape after being bent or otherwise deformed. The frame members 22 are preferably constructed from any suitable flexible plastic material, such as nylon, HYTREL, ABS, Styrene or an elastomeric material, or if desired of a metal. The frame members 22 may also be formed with other suitable resilient materials, such as polymer composite materials, or fiber reinforced plastics. If desired, the frame members 22 may have a elongated thin planar feature formed out of plastic for providing increased force to bias the shroud 38. As assembled, each frame member 22 has a "tenting resistance" which is defined as the resistance against deflection at its center point when deflected in the plane of the member 22, such as shown by arrows 99 in FIG. 4. This may be determined by using an Instron machine to apply a force of the center of the frame member 22 in the plane of the frame member 22. The machine can deflect the frame member 22 by 10 mm and the force per distance deflected is measured. In a preferred embodiment, the tenting resistances of the frame members 22 are in the range between 0.2–2.5 Newtons per millimeter, and more preferably in the range between 0.3–1.0 Newtons per millimeter. In one preferred arrangement, the tenting resistance of at least some of the frame members 22 is approximately 0.5 Newtons per millimeter.

Figure 2:
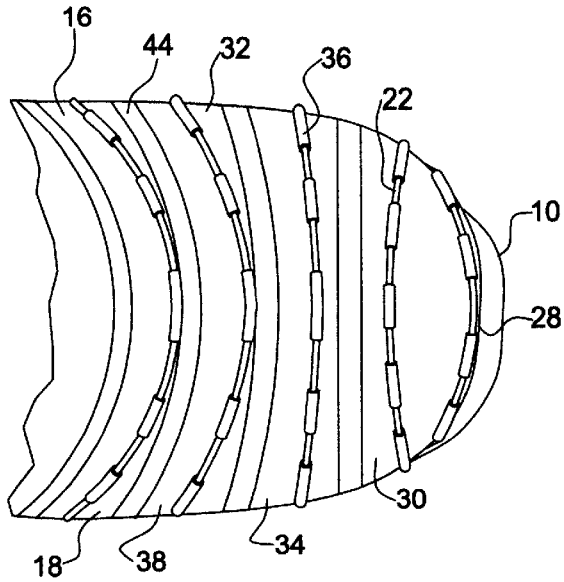
FIG. 2 is a top plan view of the forefoot region of the article of footwear shown in FIG. 1.

To provide the shoe 2 with the tented and tent-like structure and shoe shape, the frame members 22 may be threaded through a channel to urge or bias the shroud 38 off the foot 6. The frame members 22 are interconnected to the shroud 38 by a coupling system such as loops or sleeves, retained with the shroud 38 or by an adhesive. The plurality of spaced loops 36 may be disposed on the exterior or interior surface of the shroud 38. As shown in FIGS. 1 and 2, each individual frame member 22 is connected to the shroud 38 by the spaced loops 36. The loops 36 are in substantial alignment to form a pathway or channel for a frame member 22 so as to provide insertion of the members 22 through the loops 36 for connection to the medial 16 and lateral side 18 of the shoe 2. The loops 36 may be constructed of plastic or the material of the shroud 38. The loops 36 in plastic may be glued or otherwise bonded to the shroud 38. Likewise, if the loops 36 are formed with the material of the shroud 38, they may be sewn, stitched, or otherwise fastened to the shroud 38. Additionally, the coupling system may embody a plurality of sleeves (not shown) arranged in a similar alignment as the loops 36. In the sleeve arrangement, the sleeves may be constructed of the same material as the shroud 38.

In the loop or sleeve embodiment for the coupling system, the shroud 38 may move relative to the frame members 22 along the longitudinal axis of an individual frame member 22. This movement provides for greater flexibility of the upper 30 such that the shroud 38 will remain generally taut when the frame members 22 are bent or deformed. The coupling system may use an adhesive bond between the surface of the shroud 38 and the exterior surface of a frame member 22.

With reference to the embodiments shown in FIGS. 1–3, the shoe 2 further includes a foot engaging or holding system 40 that retains the foot 6 of the user. In particular, the foot engaging system 40 tightly holds the foot 6 of a wearer to the footbed 15 and sole 10. The foot engaging system 40 includes a plurality of strap members 44 for tightening and securing the foot 6. The strap members 44 are disposed on the external surface of the shroud 38 in the forefoot region and the rearfoot region of the shoe 2. This forms an exo-skeleton or skeletal type structure of narrow bands of the shoe 2 to hold the foot 6 to the sole 10. These strap members 44 minimize the amount the shoe 2 contacting the foot 6 to allow it to breathe within the upper 30. Each individual strap member 44 extends from the medial side 16 to the lateral side 18 of the shoe 2. Strap members 44 are fixedly attached to the sole 10 by any conventional manner, such as adhesive bonding, or stitching.

Referring to the forefoot region of the shoe 2, each strap member 44 is interposed between adjacent frame member 22 or at least one pair of frame members 22. This interposition facilitates the reliable connection of the foot 6 to the sole 10. The preferred quantity of strap members 44 may vary between two and five. As shown in FIG. 1, the shoe 2 includes four strap members 44 in the forefoot section and a heel locking strap 42 in the rearfoot region.

The heel locking strap 42 engages the Archilles heel portion of the foot 6 so as to secure and hold the heel to the footbed 15 and sole 10. The heel locking strap 42 is also interposed preferably between the two frame members 22 located at the heel region of the rear of the upper 30.

Referring to FIGS. 1–3, in use, the untightened or loose strap members 44 allows air to circulate around the foot 6. When the strap members 44 are tightened, small portions of the shroud 38 are pulled towards the foot 6. Minimal airflow is restricted within the upper 30 where the straps members 44 and shroud 38 contact the top of the foot 6. Because the frame members 22 are still in tension and forcing the shroud 38 away from the foot 6, a plurality of triangular-shaped air gaps 4 are formed between the frame members 22 and the strap members 44. The air gaps 4 allows the tented or tent-like upper 30 to have air to flow into the interior of the shoe 2. As such, each air gap 4 forms a channel-like arrangement extending from the medial side 16 to the lateral side of the shoe 2 whose cross section is generally triangular.

The strap members 44 and the heel locking straps 42 are constructed so as to place gentle compression forces around the periphery of the foot 6 of a wearer. As such, the compression forces may be accomplished in the variety of arrangements. The strap members 44 may be embodied by narrow bands of material. In one arrangement, the individual strap members 44 and the heel locking strap 42 may be formed with a single elastic material that stretches. In another arrangement, the strap members 44 and heel locking strap 42 may be formed with an adjustability feature having a two piece hook and loop system, similar to VELCRO® fastening system. In yet another arrangement, the strap members 44 and heel locking strap 42 may be formed with a two-piece system having an adjustable buckle with holes in a receiving strap.

FIG. 3A illustrates a cross-section of the shoe 2 taken along lines 3A—3A of the embodiment of FIG. 1 extending through a frame member 22. The cross-sectional view shows the relative position of the foot 6 of the wearer in the shoe 2 at the frame member 22. The shroud 38 is forced or tensioned away from the foot 6 by the frame members 22. The air gap 4 is formed between the shroud 38 and the foot 6. The sockliner 13 is at the bottom of the foot 6 of the wearer and footbed 15 is disposed the same. The frame members 22 have the lateral ends 24 and medial ends 26 fastened into the sole 10.

FIG. 3B illustrates a cross-section of shoe 2 taken along line 3B—3B of the embodiment of FIG. 1. This shows the relative disposition of the foot 6 at the strap member 44. The strap member 44 pulls a portion of the shroud 38 to contact the foot 6. The sockliner 13 is disposed similarly as shown in FIG. 3A.

In the embodiments shown in FIGS. 1–6, the rearfoot portion of the shoe 2 has at least two frame members 22 extending rearward from the quarter to the heel area. As such, the frame members 22 at the rear are in a diagonal arrangement.

To assist in developing the tent-like arrangement of the shoe 2, the shroud 38 preferably behaves in an elastic manner to enable it to be stretched. This permits the shroud 38 to lengthen to so as to become taut between the frame members 22 and the medial side 16 and lateral side 18 of the upper 30. To accomplish this, shroud 38 is preferably made from a woven material. The desired elastic behavior may be accomplished by using woven elastic fibers. In a preferred embodiment, the shroud 38 includes woven synthetic elastic fibers chiefly made from polyurethane, e.g., spandex. More specifically, a preferred embodiment is made from LYCRA® or another spandex fiber. LYCRA® is a trademark of the DuPont Corporation for its brand of elastane fiber. Shroud 38 may also include other types of fibers to achieve desired characteristics. Accordingly, the woven material of shroud 38 may be comprised of solely spandex or LYCRA®, or combinations of spandex and/or LYCRA®, and other materials such as nylon and/or cotton.

Additionally, these materials may also be constructed of a range of weave and knit patterns to vary the direction and amount of the elasticity of the shroud 38. In a preferred embodiment, the material is woven to provide equal four-way stretch capabilities, meaning that it stretches equally along all four planar axes. However, if desired, the woven elastic material may be formed so that it stretches more in one direction than another, such as allowing the material to stretch more or less in the vertical direction than the longitudinal direction. That is, it can stretch more or less in the direction from the ball of the foot 6 to the top of the foot, than the direction from the toe to the heel.

The material allows for breathability of the foot 6 so as to provide air to flow and penetrate the shroud 38 thereby conveying air into the interior air gaps 4 of the upper 30 and releasing the air from the interior of the upper 30. This air flow advantageously cools the foot 6 within the shoe 2 by causing an evaporative effect so as to remove moisture residing on the surface of the foot. Additionally, the material of the shroud 38 may provide protection from ultraviolet radiation. If desired, the shroud 38 may be removable or interchangeable. This removability or interchangeability provides the manufacturer with options to supply the shroud 38 in different visual appearances, breathability ratings, elasticity rating, or textures. Also the wearer is provided with a selective adjustable shroud 38. For example, a wearer may desire a tented shoe 2 having a high breathable rating for extremely hot weather, but the wearer has a shroud 38 that is rated for cooler weather. The wearer can replace the cooler weather shroud 38 with an extreme hot weather shroud 38. This interchangeable feature may be accomplished in numerous ways. One such way may be to use mechanical fasteners on the medial side 32 and the lateral side 34 of the upper 30 that is removably connected into the medial side 16 and lateral side 18 of the sole 10. The mechanical fasteners may be conventional snaps having a male part mating with a female receiving part.

Figure 6:
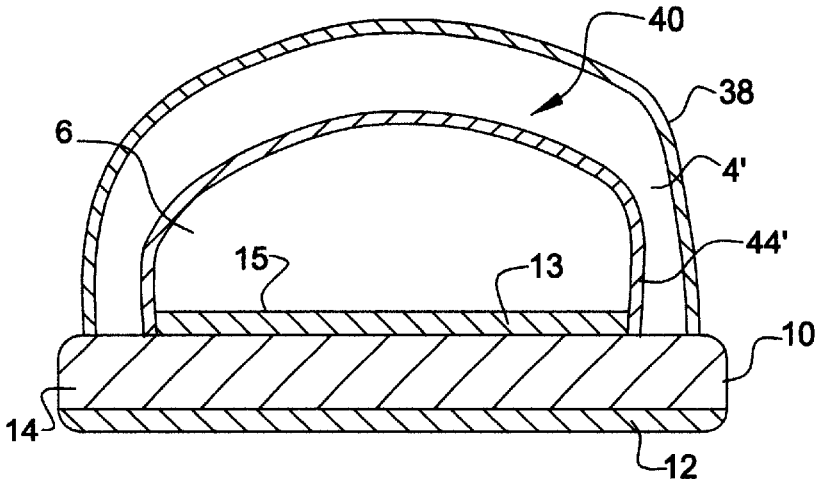
FIG. 6 is a vertical cross-sectional view taken through line 6—6 of FIG. 4.
Figure 5:
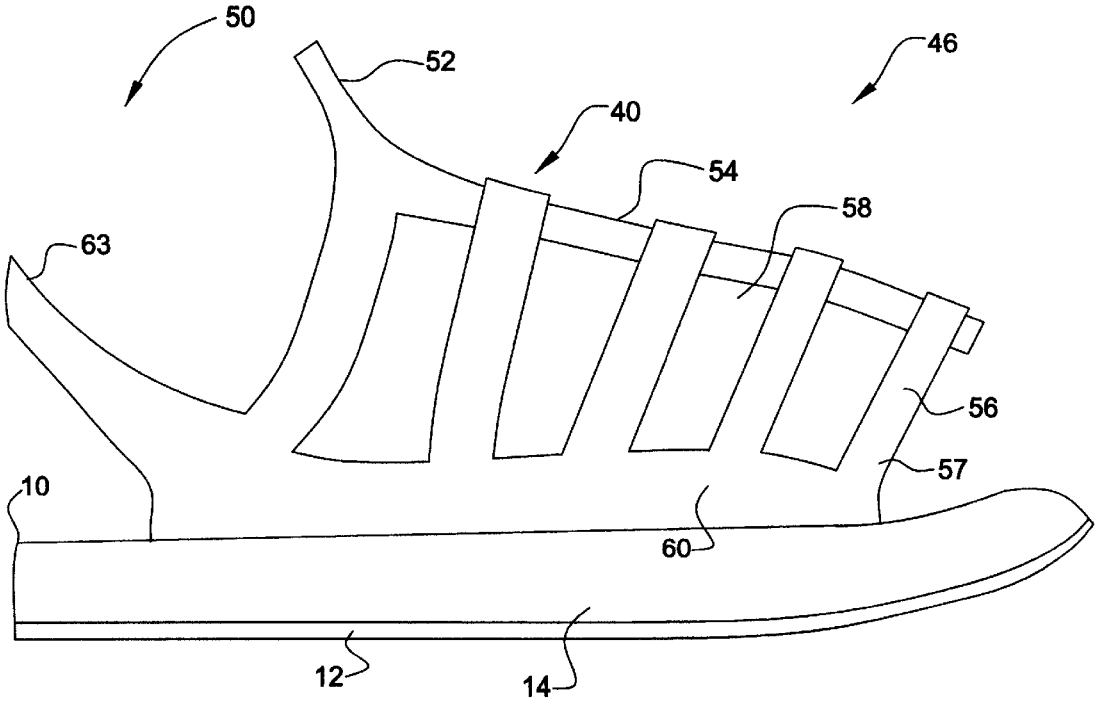
FIG. 5 is a side elevational view of the article of footwear of FIG. 4 with the shroud and frame members removed to reveal one embodiment of a foot engaging system of the present invention.

FIGS. 4–6 illustrate a schematic embodiment of the present invention having the foot engaging system 40 enclosed within the shroud 38. This embodiment is similar to the embodiment shown in FIG. 1 except that the foot engaging system 40, such as strap members 44' are disposed inside the shroud 38. The strap members 44' may be discrete elements of predetermined length for retaining the foot 6. For example, the strap members 44' may be formed of elastic bands that act to hold the foot 6 and the sole 10 together. The foot 6 of the wearer is enclosed so that the tented or tent-like structure provides protection and substantial air ventilation to the foot 6.

FIG. 5 illustrates another arrangement of the foot engaging system 40 useable with the shoe of FIG. 4 embodying an inner stretchable foot holding frame or an inner bootie system 46. The inner bootie system 46 is generally a unitary body in which the forefoot portion includes a skeletal like structure of narrow bands 54 and 56 to hold the foot 6. In one arrangement, the skeletal structure includes a longitudinal top band 54, transverse strap elements 56. The strap elements 56 substantially extend from the medial side 16 to the lateral side 18 of the shoe 2. The lower opposing ends 57 of the strap elements 56 are attached to a respective lower strap element 60. The lower strap element 60 is a narrow band of material disposed around the outer periphery of at least the side of the sole 10. Each lower strap element 60 connects the inner bootie system 46 to the sole 10 of the shoe 2 on either the medial side 16 and lateral side 18. The lower strap element 60 is fastened to the sole 10 in any conventional manner such as stitching, or gluing, or other well-known fastening techniques. The longitudinal top band 54 engages the top portion of the foot 6.

The inner bootie system further includes a plurality of holes or air vents 58. The vents 58 are large openings within the inner bootie 46 that allows air to flow and contact the surface the foot 6 of the wearer so as to ventilate the foot 6. The vents 58 are interposed between the strap elements 56 in which the vents 58 have an outer periphery formed of the strap elements 56, the longitudinal top band 54, and the lower strap element 60.

The rear of the inner bootie system 46 includes a heel strap 63. The heel strap 63 wraps around the Achilles portion of the heel of the foot 6 extending from the medial side 16 and the lateral side 18. The rear of the inner bootie system 46 further includes a foot opening 50 to receive the foot 6 of the wearer. Optionally, a front pull tab 52 may be provided. The front pull tab 52 is connected to the rear of the longitudinal top band 54. If desired, the heel strap 63 may be replaced an enclosed heel portion (not shown) extending from the top of the sole 10 and counter (not shown) to provide extra support for the foot.

The inner bootie system 46 components may be constructed from narrow bands of lightweight resilient material. The purpose of using the material is to provide the foot engaging system 40 with gentle compression forces to secure the foot 6 to the sole 10. In one arrangement, the material may be a single layer of a woven open mesh material. A material for accomplishing this may include a permeable synthetic mesh material formed from a nylon or polyester double needle bar rachel construction, such as a spacer mesh. One manufacturer of such a material is Dae Woo of Korea. In another arrangement, the material may be formed of multiple layers, such as a three layer sandwich arrangement having an exterior layer, a middle layer, and an interior layer. The exterior layer may be a woven open mesh material as described above. The middle layer may include an open cell foam material, such as polyurethane or latex, typically used in shoe construction. The interior layer may be an inner lining material. The middle cushioning layer is preferably used in the heel region. Another feasible material is a synthetic material of plastic having a weave pattern that lengthens along its longitudinal axis but shortens in the transverse direction to its longitudinal axis when the material is stretched. This may be used alone or in combination with the arrangements described above. The materials used for bands of material preferably have breathability and allow moisture to dissipate therethrough.

If desired, the inner bootie system 46 may have added fastening capability. The strap members 44 such as shown in FIG. 1 or 4 may be aligned with the strap elements 56. The lower ends of the strap members 44 are attached to the sole 10 of the shoe 2 and if desired, a middle portion of the strap members 44 may be connected to the longitudinal top band 54. This dual arrangement of the inner bootie system 56 and strap members 44 is advantageous to provide additional retaining force of the foot 6.

FIG. 6 is a cross-sectional view of the embodiment of FIG. 4 taken along line 6—6. An air gap 4' is formed between the shroud 38 and the foot 6. The frame members 22' are holding the shroud 38 away from the foot 6 in a similar manner as shown in FIG. 1. The strap members 44' or 56 engage the foot 6 of the wearer. The air gap 4' provide the wearer with substantial ventilation in which air travels through the shroud 38. It is appreciated that the air gap 4' extends around the entire upper periphery of the foot 6 located within the shroud 38. The protection function of the shroud 38 is separated from the holding function of the lightweight strap members 44' which are the main portions of the shoe 2 contacting the foot. Thus, the wearer is provided with a substantially barefoot arrangement in which the shoe acts like an extension of the foot 6 and is protected by the shroud 38.

Figure 8:
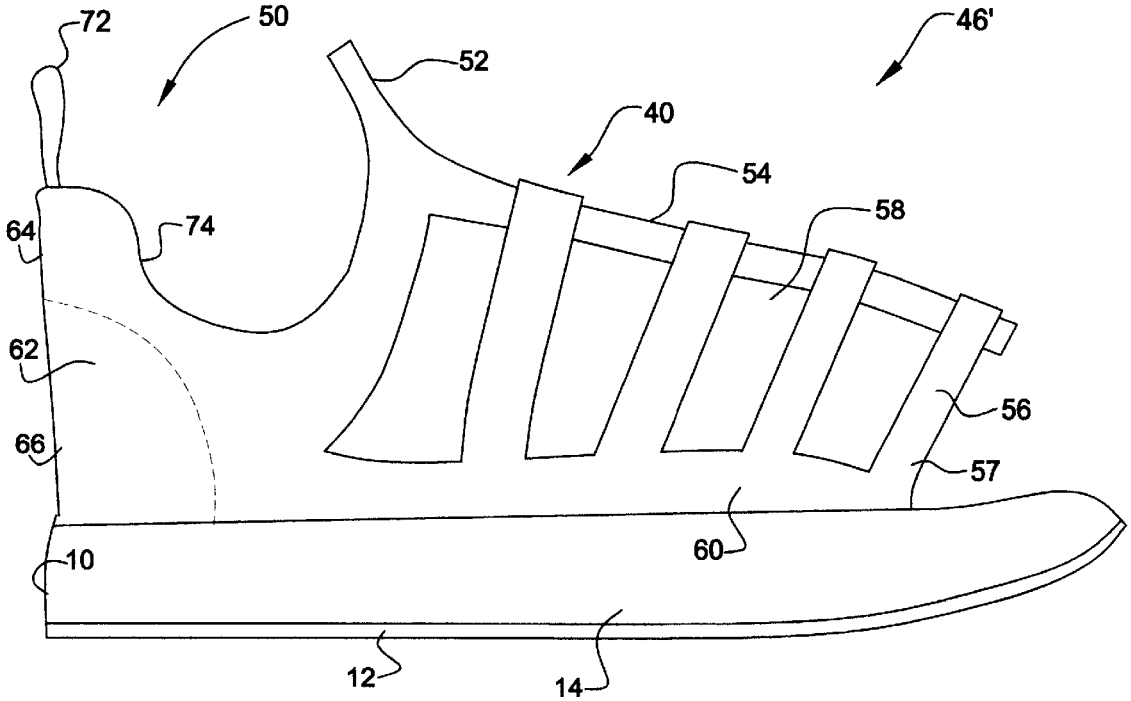
FIG. 8 is a side elevational view of the lateral side of an article of footwear of FIG. 7 revealing an alternative foot engaging system of the present invention.

With reference to FIGS. 7 and 8, a further embodiment of the present invention is shown. An article of footwear, such as a shoe 2', can include a foot bootie system 46' partially exposed due to a rearfoot section 62. This embodiment is similar to the embodiment shown in FIG. 4 except the shroud 38 covers the entire forefoot portion of the shoe 2' and not the rearfoot portion. The shoe 2' further includes a sole 10 having an outsole 12 and a midsole 14. The foot bootie system 46' is attached to the sole 10. The shoe 2 includes a shroud 38 with frame members 22 covering the forefoot region of the foot, i.e. partially covering the foot 6 of the wearer. The forefoot region of the bootie system 46' is located within the interior of the tented or tent-like structure created by the shroud 38 and frame members 22. FIG. 7 shows the frame members 22 disposed interior of the shroud 38 and coupled to the shroud 38 by adhesive bonding. Thus, the exterior surface of the shroud 38 may have ridges formed by the frame members 22 pushing the shroud 38 outward. It is noted that the frame members 22 may alternatively be coupled to the shroud 38 by other methods such as spaced loops 36 located on the interior or exterior of the shoe 2' as shown in the embodiment of FIGS. 1 and 4.

Similarly, as with the other embodiments, the embodiment of shoe 2' and the frame members 22 forces the shroud 38 away from the foot 6 of the wearer, thus forming the tent-like structure protecting the foot 6 from debris and other objects that may injure the foot 6. Referring to FIG. 8, the foot bootie system 46' is similar to the embodiment of the foot engaging system 40 shown in FIG. 5. The forefoot portion of the bootie 46' includes a structure of material similar to inner bootie 46. The rearfoot portion of bootie 46' is similar to inner bootie 46, except heel strap 42 has been eliminated. The bootie 46' has a similar function to ventilate the foot 6 or inner bootie 46 cooperation with the shroud 38 in the embodiment of FIG. 4.

Referring to the rearfoot portion of the foot bootie system 46', a rearfoot section 62 includes a heel section 64 and an ankle collar 74. The rearfoot section 62 includes the foot opening 50 to receive the foot 6 of the wearer. The rearfoot section 62 substantially encloses the rear of the foot. The enclosed heel section 64 wraps around the heel of the foot 6 extending from the medial side 16 and the lateral side 18. The ankle collar 74 is disposed at the top portion of the rearfoot section 62 and provides comfortable contact surface to the Achilles tendon area of the foot 6 of a wearer. Optionally, the rearfoot section 62 may include a rear pull tab 72. A front pull tab 52 may be provided at the front of opening 50. If desired, the heel section 64 can include a counter 66 to provide extra support for the foot.

The counter 66 is a stiffened portion of foot bootie system 46' disposed within the heel section 64, and is preferably made from plastic, or a similar material. The counter 66 extends upwardly from the top surface of sole 10 and includes a lower portion 68. The lower portion 68 is proximate to the top surface of sole 10 and further secures the base of a foot 6 by resisting medial and lateral motion of the foot 6 of the wearer. The counter 66 supports the heel and Achilles tendon area of the foot 6 of a wearer. The counter 66 may be varied in many ways to optimize support and minimize weight depending upon the type of activity. For instance, it may be beneficial for running shoes to include the additional stiffness provided by a counter to reduce pronation of the foot. If desired, the embodiment of FIGS. 1–3 can be modified so that the shroud 38 and foot holding system 40 cover the forefoot region only, similar to the embodiment depicted in FIG. 7.

The present invention has been described in terms of preferred and exemplary embodiments thereof. Accordingly, numerous other embodiments, modifications and variations within the scope and spirit of the appended claims will occur to persons of ordinary skill in the art from a review of this disclosure.

We claim:

1. An article of footwear, comprising:

a sole having at least a midsole;

a shroud for covering at least a forefoot portion of a foot of a user;

a foot holding system for holding the foot of the user to the sole and said foot holding system including at least a forefoot portion being disposed within the shroud; and at least one frame member in a spaced relationship from the foot holding system, said at least one frame member having a medial end, a lateral end, and a central region therebetween, said medial end and said lateral end being attached to said midsole on opposing sides, said at least one frame member for biasing the shroud away from the foot of the user.

2. An article of footwear, comprising:

a sole having at least a midsole;

a shroud for covering at least a forefoot portion of a foot of a user;

a foot holding system for holding the foot of the user to the sole and at least one frame member in a spaced relationship from the foot holding system, said at least one frame member having a medial end, a lateral end, and a central region therebetween, said medial end and said lateral end being attached to said midsole on opposing sides, said at least one frame member for biasing the shroud away from the foot of the user; wherein the foot holding system includes a plurality of straps extending from the sole, said straps being disposed within said shroud.

3. An article of footwear, comprising:

a sole having at least a midsole;

a shroud for covering at least a forefoot portion of a foot of a user;

a foot holding system for holding the foot of the user to the soleand at least one frame member in a spaced relationship from the foot holding system, said at least one frame member having a medial end, a lateral end, and a central region therebetween, said medial end and said lateral end being attached to said midsole on opposing sides, said at least one frame member for biasing the shroud away from the foot of the user; wherein the foot holding system includes an inner foot holding frame disposed within said shroud, said inner foot holding frame including at least two spaced transverse elements extending from a medial side of the sole to a lateral side of the sole and a longitudinally disposed element connecting the transverse elements.

4. The article of footwear of claim 3, wherein the inner foot holding frame includes ventilation openings formed between the transverse elements.

5. The article of footwear of claim 3, wherein said inner foot holding frame includes a rearfoot section for engaging a rearfoot portion of said foot of said user, said rearfoot section extending between a medial side to a lateral side of said sole.

6. The article of footwear of claim 5, wherein said rearfoot section includes a strap extending from said medial side to said lateral side of said sole.

7. The article of footwear of claim 5, wherein said rearfoot section is configured to substantially wrap around said rearfoot portion of said foot of said user.

8. The article of footwear of claim 1, wherein said shroud is composed of at least a woven material for conveying air into said at least of a forefoot portion of said foot of said user.

9. The article of footwear of claim 1, wherein said foot holding system includes an inner bootie having an opening for receiving said foot of said user therein.

10. The article of footwear of claim 9, wherein the inner bootie includes a heel section extending from the sole for engaging a portion of a heel of the foot of the user.

11. An article of footwear comprising:

a sole including a midsole having a medial and a lateral side;

an elastic shroud for covering a foot of a user, the shroud having a rearwardly disposed foot opening;

at least one frame element for holding the elastic shroud away from the foot of the user, said at least one frame element extending from the medial side to the lateral side of said midsole, said at least one frame member being attached to the midsole; and a foot bootie for holding the foot of the user to the sole.

12. The article of footwear of claim 11, wherein said elastic shroud includes a ventilating material for conveying air therein, and said inner bootie being configured to receive said air for facilitating air to flow to said foot of the user.

13. An article of footwear comprising:

a sole including at least a midsole;

a foot holding system for holding a foot of a user to the sole, said foot holding system including at least a forefoot portion being separated from the shroud defining an air gap therebetween; and a tented shroud, including a shroud and a frame member attached to the midsole.

14. The article of footwear of claim 13, wherein the foot holding system includes a plurality of foot holding bands extending from a medial side and a lateral side of said sole and said foot holding bands are connected to the sole at said medial side and said lateral side, respectively.

15. An article of footwear comprising:

a sole including at least a midsole;

a foot holding system for holding a foot of a user to the sole; and a tented shroud, including a shroud and a frame member attached to the midsole; wherein the foot holding system includes a plurality of foot holding bands extending from a medial side and a lateral side of said sole and said foot holding bands are connected to the sole at said medial side and said lateral side, respectively; wherein the plurality of foot holding bands are disposed within the tented shroud.

16. The article of footwear of claim 14, wherein the plurality of foot holding bands are disposed outside of the tented shroud.

17. The article of footwear of claim 13, wherein the tented shroud encloses an entire forefoot portion of the foot of the user.

18. The article of footwear of claim 13, wherein the frame member extends from a medial side to a lateral side of the sole.

19. The article of footwear of claim 13, wherein said foot holding system includes an inner bootie.

20. An upper for an article of footwear, comprising:

a foot opening for receiving a foot of a wearer;

an elastic shroud for covering the foot and for conveying air to said foot of said wearer; and at least one frame member being connected to the shroud for tenting the shroud away from said foot of said wearer; wherein the at least one frame member extends from a rearfoot portion to a position in front of the foot opening.

21. The upper of claim 20, further wherein said least one frame member includes a medial end and a lateral end disposed in a rearfoot portion of said upper.

22. The upper of claim 21, further including a plurality of frame members.

23. The upper of claim 21, wherein the elastic shroud covers only a forefoot portion of the foot of the wearer.

24. An article of footwear comprising:

a sole having a medial side and a lateral side;

a shroud for covering at least a forefoot portion of foot of a user;

a foot engaging system having an inner elastic frame for holding the foot of the user to the sole, said inner elastic frame including at least two spaced transverse elements extending from said medial side of the sole to said lateral side of the sole and a longitudinal element connecting the transverse elements together; and a frame member away spaced from the foot engaging system, the frame member biasing the shroud away from the foot of the user.

25. The article of footwear of claim 24, wherein the inner elastic frame includes vent openings formed between the transverse elements.

26. The article of footwear of claim 24, wherein said inner elastic frame further includes a medial longitudinal element and a lateral longitudinal element connecting the transverse elements together on said medial side and said lateral side, respectively.

27. The article of footwear of claim 26, wherein said medial longitudinal element and said lateral longitudinal element are attached to the sole.

28. The article of footwear of claim 24, wherein said inner elastic frame further includes a heel engaging traverse element.

29. An article of footwear comprising:

a sole having a medial side and a lateral side;

a foot holding system for holding a foot of a user to the sole; and a tented shroud, including a shroud and at least one frame member attached to the medial side and the lateral side of the sole; wherein the at least one frame member extends around a heel portion of a foot of the user.

30. The article of footwear of claim 29, wherein the foot holding system includes a plurality of straps extending from the medial side and the lateral side of the sole.

31. The article of footwear of claim 30, wherein the foot holding system is disposed within the tented shroud.

32. The article of footwear of claim 29, further including a plurality of frame members forming a framework for the tented shroud.

33. The article of footwear of claim 29, wherein the tented shroud encloses an entire forefoot portion of the foot of the user.

34. An upper for an article of footwear comprising:

a foot opening for receiving a foot of a wearer;

a flexible sheet of material for covering at least a forefoot portion of the foot of a wearer; and a plurality of frame members connected to the sheet of material for tenting the flexible sheet of material from the foot of the wearer; wherein at least one frame member of the plurality of frame members extends forwardly and upwardly from a rearfoot portion to a location in front of the foot opening.

35. The upper of claim 34, wherein frame members are elongated rods extending from a medial side of the article of footwear to a lateral side of the article of footwear.

36. The upper of claim 35, further comprising a plurality of longitudinally-spaced transverse foot holding straps.

37. The upper of claim 34, wherein said flexible sheet material covers at a rearfoot portion of the foot the wearer.

* * * * *

UNITED STATES PATENT AND TRADEMARK OFFICE

CERTIFICATE OF CORRECTION

PATENT NO. : 6,594,918 B2
DATED : July 22, 2003
INVENTOR(S) : Tinker L. Hatfield et al.

It is certified that error appears in the above-identified patent and that said Letters Patent is hereby corrected as shown below:

Title page,

Item [56], References Cited, OTHER PUBLICATIONS, the following has been added:

| | | |
|---|---|---|
| -- 11,947 | 11/1854 | Pease |
| 757,424 | 4/1904 | Vohl |
| 1,258,629 | 4/1918 | Bliss |
| 5,497,564 | 5/1996 | Allen et al. |
| 5,659,982 | 8/1997 | Muraoka et al. |
| 5,704,138 | 1/1998 | Donnadieu |
| 6,029,376 | 2/2000 | Cass |
| Des. 47,238 | 4/1915 | Miller |
| 4,908,963 | 3/1990 | Krajcir et al. |
| 5,878,511 | 3/1999 | Krajcir |
| 3,102,347 | 9/1963 | Griswold et al. |
| 1,952,294 | 3/1934 | A.A. Strauss |
| 1,663,319 | 3/1928 | J.B. Snell |
| 2,160,768 | 5/1939 | H.N. Wasser |
| 2,392,867 | 1/1946 | N.F. Stoner et al. |
| 4,656,761 | 4/1987 | Lord |
| 4,231,170 | 11/1980 | Griswold |
| 3,175,311 | 3/1965 | C. MacQuaid |
| 1,900,515 | 3/1933 | C. Miller |
| 2,015,479 | 9/1935 | H. Koomruian |
| 494,598 | 4/1893 | G.H. Russell -- |

Signed and Sealed this

Twenty-fifth Day of November, 2003

JAMES E. ROGAN
*Director of the United States Patent and Trademark Office*